United States Patent [19]

Kobayasi

[11] Patent Number: 4,635,386

[45] Date of Patent: Jan. 13, 1987

[54] PAVED ASPHALT STRIPPING AND DIGGING BUCKET APPARATUS

[75] Inventor: Soichi Kobayasi, Chiba, Japan

[73] Assignee: Kabushiki Kaisha SK, Chiba, Japan

[21] Appl. No.: 774,573

[22] Filed: Sep. 10, 1985

[30] Foreign Application Priority Data

Sep. 10, 1984 [JP] Japan ..... 59-136981[U]

[51] Int. Cl.[4] ..... E02F 3/76

[52] U.S. Cl. ..... 37/117.5; 37/DIG. 3; 414/739

[58] Field of Search ..... 37/117.5, 103, DIG. 3; 414/685, 722, 723, 724, 726, 728, 738, 739, 740

[56] References Cited

U.S. PATENT DOCUMENTS 4,495,717 1/1985 Lockwood ..... 37/DIG. 3

FOREIGN PATENT DOCUMENTS 838640 7/1960 United Kingdom ..... 37/103

827695 5/1981 U.S.S.R. ..... 37/103

*Primary Examiner*—E. H. Eickholt

*Attorney, Agent, or Firm*—Oblon, Fisher, Spivak, McClelland, & Maier

[57] ABSTRACT

A paved asphalt stripping and digging bucket apparatus is disclosed which is capable of effectively carrying out the stripping-off and digging of a paved asphalt. In the apparatus, a bucket connected to an arm and a hydraulic cylinder of a tractor shovel has a bottom surface formed into a shape having a radius when it is viewed sideways, to thereby facilitate the pivotal penetration of pawls of the bucket between the asphalt and a sublayer and allow the pawls to act as a lever on which the fulcrum is on the sublayer.

4 Claims, 9 Drawing Figures

PAVED ASPHALT STRIPPING AND DIGGING BUCKET APPARATUS

BACKGROUND OF THE INVENTION

1. Field of the Invention

This invention relates to a paved asphalt stripping and digging bucket apparatus, and more particularly to such a bucket apparatus which is adapted to allow pawls provided at the tip end of a bucket to be penetrated between the asphalt and its sublayer and act as a lever generating large force to effectively and positively carry out the stripping and digging of the paved asphalt.

2. Description of the Prior Art

A typical bucket apparatus of such type which has been conventionally known in the art is constructed in such a manner as shown in FIG. 2. More particularly, a conventional bucket apparatus indicated by reference character A' in FIG. 2 includes a bucket section a' of which the bottom surface 21' extending to digging pawls 22' is formed into a linear shape. Accordingly, when the bucket apparatus is used to strip and dig a paved asphalt below which soil lies as a sublayer, the pawls 22' of the bucket deeply enter the soil and the subsequent upward swinging of the bucket digs up only soil and fails to strip and lift the asphalt. Furthermore, when the asphalt lies on a rigid sublayer such as concrete, the pawls strike against the sublayer and are prevented from penetrating it, and the pawls only make holes in the asphalt and fail to accomplish the stripping and digging.

Thus, the conventional bucket apparatus was used to strip and dip up the paved asphalt after it is crushed to pieces of a size sufficient by using suitable means such as an air hammer.

Accordingly, it is desirable to develop a bucket apparatus as an attachment of a hydraulic soil discharge and digging machine, which is capable of allowing pawls of a bucket to be smoothly penetrated between a paved asphalt and its sublayer so as to strip and lift only the asphalt from the sublayer and permitting the lifted asphalt to be positively received in the bucket.

In general, a paved asphalt is stripped in the form of pieces each having excessive size (for example, 20–40 cm in thickness) and weight. Accordingly, the conventional bucket apparatus often fails to successfully carry the stripped paved asphalt on the center of the bucket, due to loss of the balance. Also, this often causes the stripped asphalt to partially project from the bucket. Further, this leads to the dropping of the stripped asphalt from the bucket during the transferring to transportation means such as a truck. Thus, the discharge of the asphalt by the conventional bucket apparatus must be carried out after it is crushed into small pieces, resulting in the operating efficiency being highly deteriorated.

OBJECTS OF THE INVENTION

The present invention has been made in view of the foregoing disadvantages of the prior art.

Accordingly, it is an object of the present invention to provide a paved asphalt stripping and digging bucket apparatus which is capable of allowing pawls of a bucket to be positively penetrated between the paved asphalt and its sublayer and act as a lever generating large force, to thereby effectively accomplish the stripping and digging of the asphalt.

It is another object of the present invention to provide a paved asphalt stripping and digging bucket apparatus which is capable of crushing stripped asphalt into pieces of a small size sufficient to be readily handled and safely receiving the crushed asphalt pieces in a bucket.

It is a further object of the present invention to provide a paved asphalt stripping and digging bucket apparatus which is capable of accomplishing the above-described object with a simple structure.

SUMMARY OF THE INVENTION

In accordance with the present invention, there is provided a paved asphalt stripping and digging bucket apparatus comprising a bucket which is adapted to be detachably connected to an arm of a hydraulic soil discharge and digging machine of various types for civil engineering works, such as, for example, a hydraulic tractor shovel, and actuated by means of a hydraulic cylinder. The bucket includes a bracket integrally mounted on the upper portion thereof which is connected to the arm and hydraulic cylinder, and a bottom surface formed into a shape having a radius when it is viewed sideways.

Also, in accordance with the present invention, there is provided a paved asphalt stripping and digging bucket apparatus comprising a bucket pivotally connected to a bracket provided at the tip end of an arm of a hydraulic soil discharge and digging machine of various types for civil engineering works, such as, for example, a hydraulic tractor shovel. The bucket includes a bottom surface formed into a shape having a radius when it is viewed sideways. A holding arm is pivotally mounted on the bucket so as to be opposite to the upper surface of the bucket, and a link mechanism and a hydraulic cylinder each connected to the bucket and holding arm are provided to cause the bucket and holding arm to be openably swung by a predetermined angle in relation to each other.

The bucket apparatus according to the present invention of such construction, when it is desired to strip and dig a paved asphalt for the reason of the repaving or the like, for example, to strip and dig a paved asphalt cut at predetermined widths, for example, of 80 to 100 cm for a gas fitting work or waterworks, effectively accomplishes the stripping and digging of the asphalt, the dipping-up of various sizes of heavy-walled asphalt pieces digged into the bucket, the striking of the holding arm against the dipped-up asphalt pieces to crush the asphalt pieces into smaller pieces, the holding of the asphalt pieces between the bucket and the holding arm, transferring of the asphalt pieces to transportation means such as a truck, and the discharge of the asphalt pieces to the transportation means.

BRIEF DESCRIPTION OF THE DRAWINGS

These and other objects and many of the attendant advantages of the present invention will be readily appreciated as the same becomes better understood by reference to the following description when considered in connection with the accompanying drawings in which like reference characters designate like or corresponding parts throughout; wherein.

DETAILED DESCRIPTION OF THE PREFERRED EMBODIMENT

Now, a paved asphalt stripping and digging bucket apparatus according to the present invention will be described hereinafter with reference to the accompanying drawings.

Figure 1:
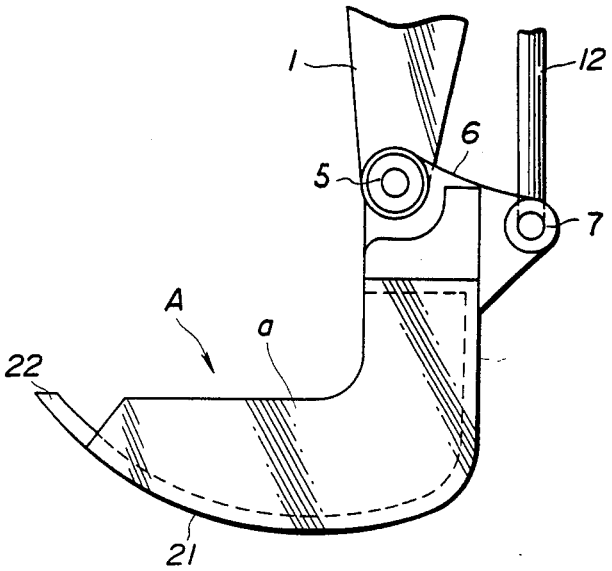
FIG. 1 is a side elevation view schematically showing the construction of an embodiment of a bucket apparatus according to the present invention.

FIG. 1 shows the general structure of an embodiment of a paved asphalt stripping and digging bucket apparatus according to the present invention. A paved asphalt stripping and digging bucket apparatus illustrated in FIG. 1 is adapted to be detachably mounted to an arm of various types of a hydraulic soil discharge and digging machine for civil engineering works, such as, for example, a hydraulic tractor shovel and actuated by a hydraulic cylinder. The bucket apparatus of the illustrated embodiment comprises a paved asphalt stripping and digging bucket A (hereinafter referred to as "bucket A") which includes a bucket section (a), a bracket 6 provided at the upper portion of the bucket section (a) so as to be integral with the bucket section through which the bucket section is connected to an arm 1 and a hydraulic cylinder 11 (shown in FIG. 4) of a tractor shovel. The bucket section (a) has a bottom surface 21 formed into a shape having a radius (hereinafter referred to as "R shape") when it is viewed sideways. In FIG. 1, reference numeral 12 designates a piston rod of the hydraulic cylinder 11, and reference numeral 22 designates a plurality of pawls provided at the tip end of the bucket section (a).

Now, the manner of operation of the bucket apparatus of the illustrated embodiment constructed as described above will be described with reference to FIGS. 3A to 3D.

First, a boom (not shown) and the arm 1 of, for example, a tractor shovel are operated to transfer the bucket A to an intended place. Then, the hydraulic cylinder 11 is actuated to downward swing the bucket A which was initially lifted to the upper position or upward opened by an angle of about 90 degrees due to the pivotal movement to cause the pawls 22 to penetrated through a paved asphalt 23, as shown in FIG. 3A.

Figure 3:
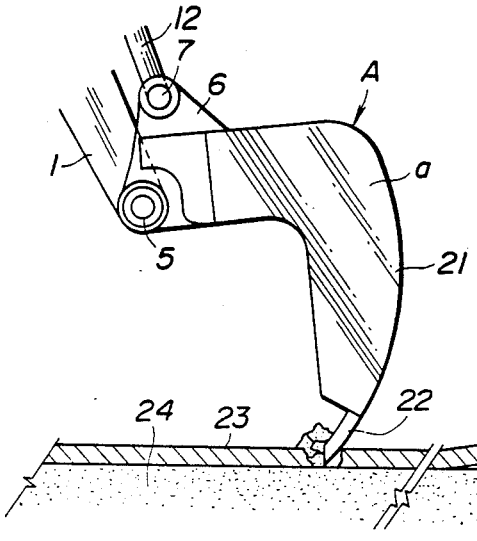
FIGS. 3A to 3D each are a side elevation view showing the operation of bucket apparatus of FIG. 1.
Figure 3:
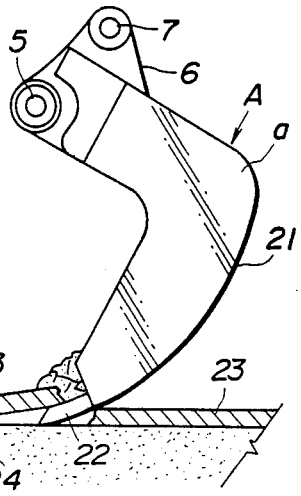
Figure 3:
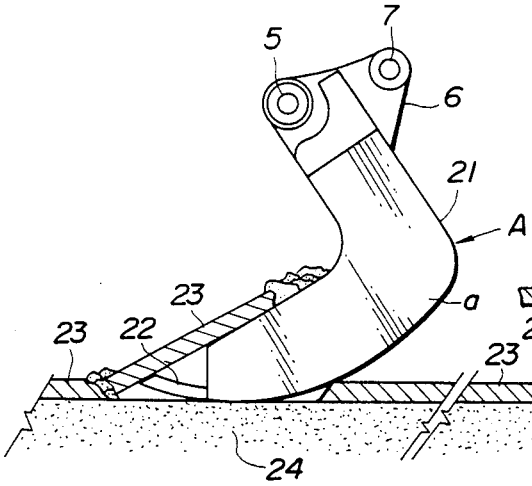
Figure 3:
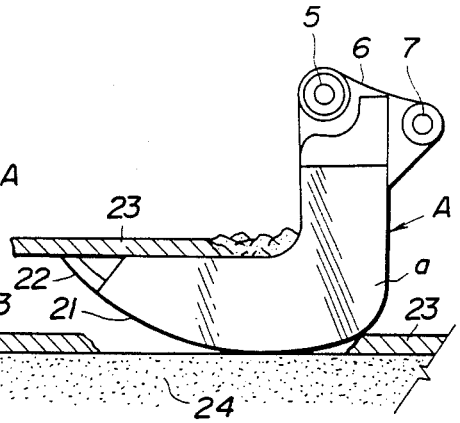

Then, when the bucket A is further swung in the clockwise direction, the pawls 22 are forward swung in a manner to draw an arc, to thereby be penetrated between the lower surface of the asphalt 23 and a sublayer 24, such as, for example, soil, concrete or the like below the asphalt, as shown in FIG. 3B.

Subsequently, when the bucket A is further forward swung, the pawls 22 and the bucket section (a) are forward moved along the lower surface of the asphalt 23. Concurrently, the R-shaped bottom surface 21 of the bucket section (a) acts as a lever of which the fulcrum is on the surface of the sublayer 24 to strip off and lift the asphalt 23 with large force, as shown in FIG. 3C.

Thereafter, when the bucket A is further forward moved due to the pivotal movement, stripped-off and lifted asphalt 23 is broken into a plate-like piece, which is then carried on the bucket A. Then, the bucket A on which the broken asphalt piece is put is transferred to entruck the asphalt piece. Finally, the bucket A is returned to the original position for a subsequent asphalt discharge operation. The bucket apparatus of the illustrated embodiment is conveniently applicable to the operation of digging and discharging soil or the like other than a paved asphalt in the same manner as described above, as in a conventional bucket.

Figure 4:
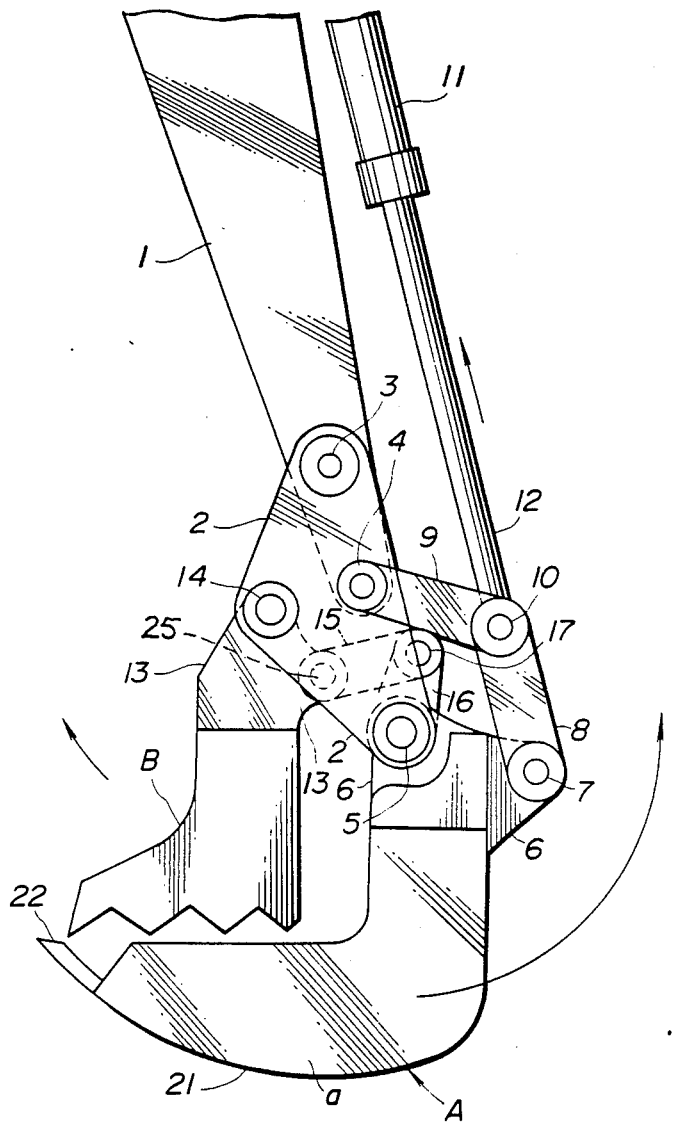
FIG. 4 is a side elevation view showing another embodiment of a bucket apparatus according to the present invention.
Figure 5:
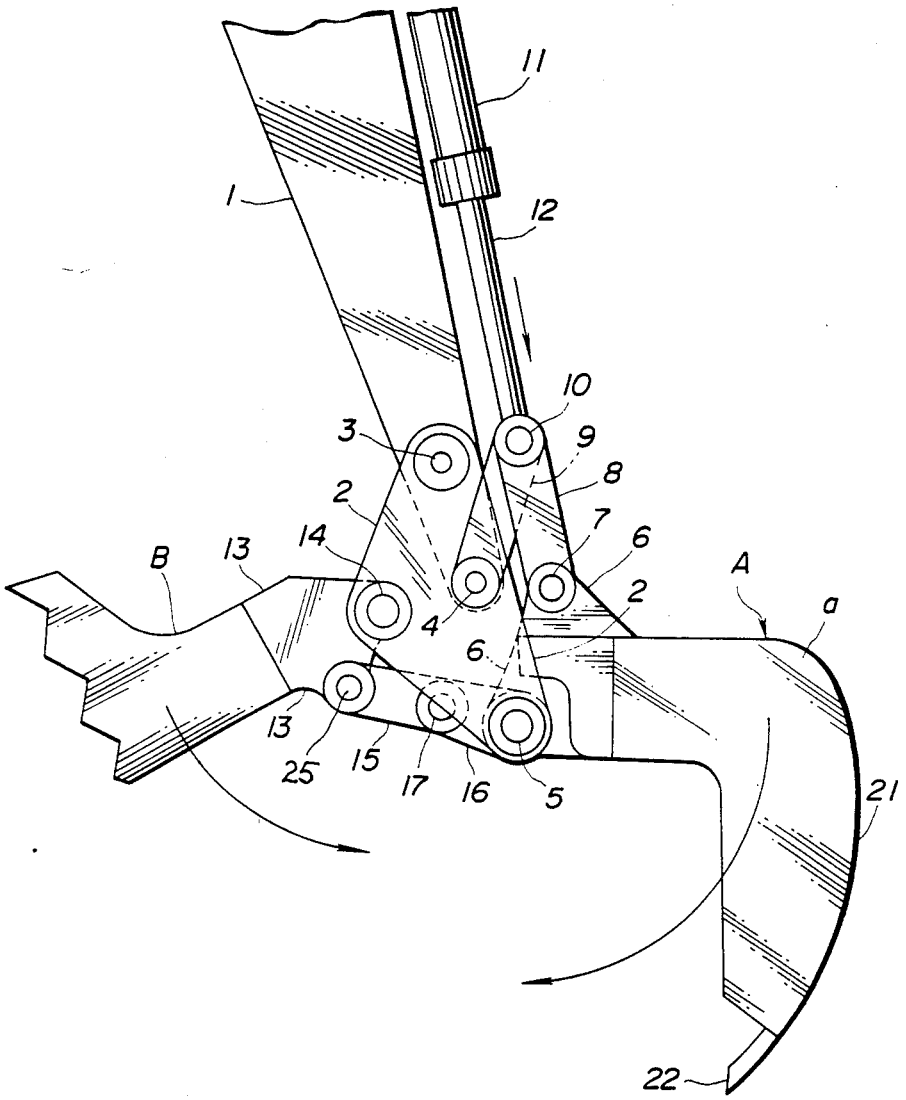
FIG. 5 is a side elevation view showing the operation of the bucket apparatus shown in FIG. 4.
Figure 6:
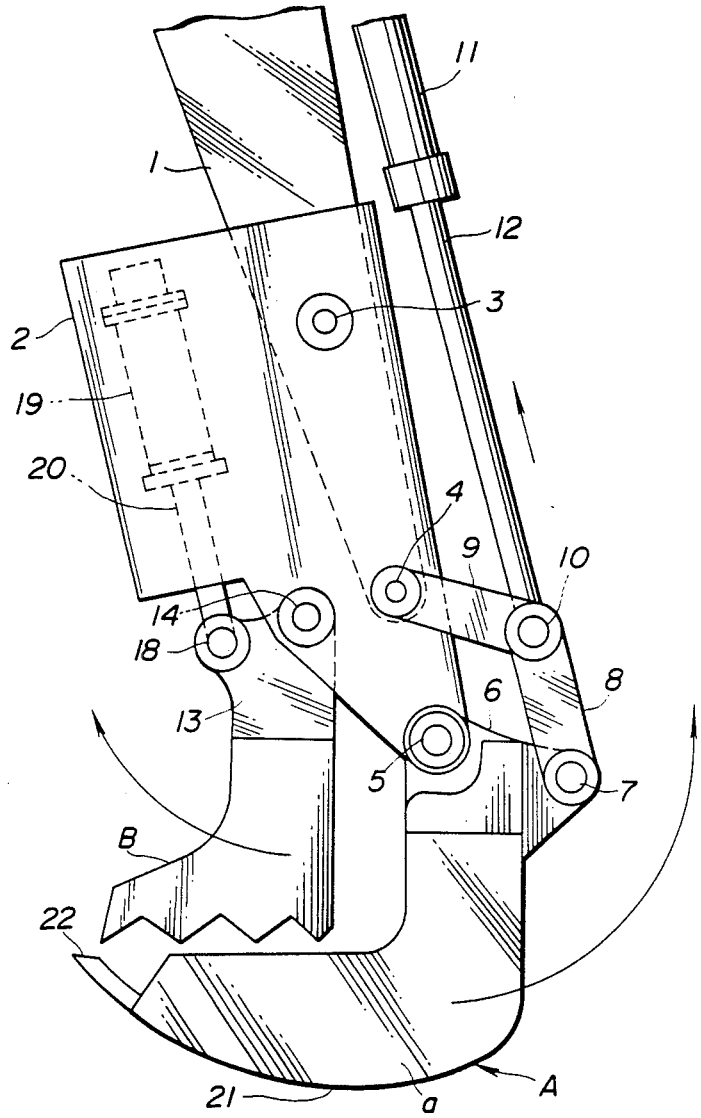
FIG. 6 is a modification of the bucket apparatus shown in FIG. 4 wherein a hydraulic cylinder is used as means for swinging a holding arm.

FIGS. 4 to 6 illustrate another embodiment of a paved asphalt stripping and digging bucket apparatus according to the present invention.

Figure 2:
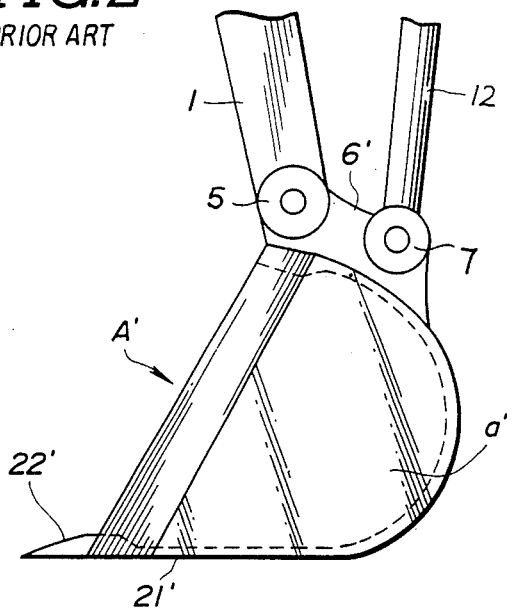
FIG. 2 PRIOR ART
FIG. 2 is a side elevation view schematically showing the construction of a conventional bucket apparatus.

Briefly speaking, the embodiment shown in FIGS. 4 to 6 comprises a bucket A constructed in substantially the same manner as in the embodiment shown in FIG. 2 and a holding arm B attached to the bucket A.

More particularly, the bucket apparatus shown in FIGS. 4 to 6 includes a bucket A provided at the upper portion thereof with a bracket 6. The bracket 6 is pivotally connected by a pivot shaft 5 at the forward end thereof to the lower portion of a bracket 2. The bracket 2 in turn is pivotally connected by a pivot shaft 3 to an arm 1 of a a hydraulic soil discharge drilling machine for civil engineering works, such as, for example, a hydraulic tractor shovel. The bucket A is pivotally moved with respect to the arm 1 through the bracket 2. In the illustrated embodiment, the bracket 2 is formed into a triangle shape, and it is detachably connected at one side arm 1 by means of the pivot shafts 3 and 4. The bracket 6 of the bucket A is provided at the rear end thereof with a link 8 which is pivotally connected at one end thereof to the bracket 6 by means of a pivot shaft 7. The link 8 is pivotally connected at the other end thereof to one end of a link 9 by means of a connecting shaft and to the piston rod 12. The link 9 is pivotally mounted at the other end thereof on a connecting shaft 4 which is pivotally mounted in the bracket 2 and in the arm 1. The links 8 and 9 are connected together through the connecting shaft 10 to the tip end of the piston rod 12 of a hydraulic cylinder 11.

The illustrated embodiment also includes a holding arm B having a bracket 13 fixedly mounted on the upper portion thereof. The bracket 13 is pivotally connected at the forward end thereof to the forward end of the triangle bracket 2 of the arm 1 by means of a connecting shaft 14. Also, the holding arm B is arranged in a manner such that the lower surface thereof is in proximity to the upper surface of the bucket A.

The bracket 13 of the holding arm B may have a link 15 pivotally mounted thereon by a pivot shaft 25. The link 15 is then pivotally connected by means of a connecting shaft 17 to an arm 16 fixedly mounted on the bucket A at a given angle with respect to the bucket. Alternatively, as shown in FIG. 6, the bracket 13 may be connected at the front portion thereof through a connecting shaft 18 to the tip end of a piston rod 20 of a hydraulic cylinder 19.

The holding arm B may be formed into a shape corresponding to the shape of the upper surface of the bucket A, for example, a substantially L-shape. Further, the overall holding arm B may be constructed using a pair of side plates and a bottom plate as in the bucket A. Alternatively, it may be formed of a plurality of L-shaped vertical plates which are securely arranged at equal intervals in the lateral direction.

It should be noted that the hydraulic cylinder 19 shown in FIG. 6 which is one of the means for pivotally actuating the holding arm B is not provided in any conventional hydraulic soil discharge and digging machine known in the art.

The manner of operation of the embodiment shown in FIGS. 4 to 6 will be described hereinafter.

In FIG. 4, the bucket A and holding arm B are moved to a closed position. This also corresponds to a state that asphalt pieces digged and dipped up by the bucket A are interposedly supported between the bucket A and the holding arm B moving downward due to the pivotal movement.

First, when the piston rod 12 of the hydraulic cylinder 11 is retracted to swing the link 8, the link 9 causes the bucket A to be upward swung or opened by an angle of about 90 degrees about the shaft 5.

In the construction in which the bucket A and holding arm B are connected to each other through the arm 16 and the link 15, the upward rotation of the bucket A by 90 degrees causes the arm 16 to be upward swung to forward push the link 15 so that the link 15 upward swings to open the holding arm B by an angle of about 80 degrees about the shaft 14.

In the construction wherein the hydraulic cylinder 19 is used as shown in FIG. 6, the upward rotation of the bucket A causes the piston rod 20 connected to the connecting shaft 18 to be retracted in synchronism therewith so that the holding arm B may be upward swung or opened by an angle of about 80 degrees about the shaft 14.

Now, the above-described operation will be further described hereinafter with respect to the digging of a paved asphalt 23 and soil discharge with reference to FIGS. 4 to 6.

A boom (not shown) and the arm 1 of the tractor shovel are actuated in a state that the bucket A and holding arm B are upward swung or opened, respectively, as shown in FIG. 5, so that the bucket and holding arm may be transferred to a predetermined place. Then, the arm 1 is downward moved to plant pawls 22 of the bucket A into a paved asphalt, and then the piston rod 12 of the hydraulic cylinder 11 is forward moved to gradually downward swing the bucket A, to thereby strip off the asphalt 23 and dig up soil thereunder. At this time, the pawls 22 are caused to forward and upward penetrate between the asphalt 23 and the sublayer 24 or soil in a manner to draw an arc after it enters into the asphalt 23 and concurrently act as a lever of which the fulcrum is on the surface of the soil, because the bottom surface of the bucket A is formed into an R-shape. Therefore, the asphalt 23 is stripped off and lifted with large force. Thus, the asphalt can be readily dug up with good efficiency. When the pivotal movement of the holding arm B is carried out by means of the link mechanism, the holding arm B is gradually downward swung with the digging operation of the bucket A.

The digging operation of the bucket A terminates at the position shown in FIG. 4 at which the bucket A is downward swung by an angle of about 90 degrees. In this instance, when the swinging means for the holding arm B is the link mechanism, the downward swinging of the holding arm B terminates at the same time. On the other hand, when the hydraulic cylinder 19 is used as the swinging means, the piston rod 20 of the hydraulic cylinder 19 is moved to extend in synchronism with the termination of the digging operation of the bucket A to downward swing the holding arm B, and the asphalt pieces dug up by and carried on the bucket A are downward pressed by the holding arm B to be crushed into smaller pieces and securely received in the bucket A closed with the holding arm.

Thereafter, the arm 1 and boom of the tractor shovel are actuated in a state that the asphalt pieces are pressedly held between the bucket A and the holding arm B to transfer the pieces to a desired place such as, for example, a bed of a truck or the like, at which the bucket A and holding arm B are upward swung or pivotally opened to discharge the asphalt pieces to the place.

As can be seen from the foregoing, the bucket A of the present invention exhibits an excellent advantage capable of effectively carrying out the stripping-off and digging of a paved asphalt which is highly troublesome to the conventional apparatus, because the unique construction of the present invention that the bottom surface of the bucket A formed into an R-shape allows the pawls of the bucket to positively penetrate between the asphalt and a sublayer therebelow and act as a lever of which the fulcrum is on the sublayer to generate large force sufficient to strip off and dig up the asphalt.

Also, in the present invention, the holding arm can crush a plate-like asphalt piece large in size and weight dug up by the bucket and received therein into pieces of a small size easy to be handled, and the bucket and holding arm cooperate together to interposedly hold the crushed asphalt pieces therebetween to prevent the pieces from dropping therefrom.

It is a matter of course that the present invention is capable of being effectively applied, in addition to the stripping and digging of the paved asphalt described above, in various operations carried out by a usual bucket such as the digging of soil, a paved concrete and the like, soil discharge, demolition and removal of a building, and the like. In particular the apparatus of the present invention is most suitable for use for the operation of dealing with matters large in size and weight which the conventional bucket is hard to treat.

While preferred embodiments of the invention have been described with a certain degree of particularlity with reference to the drawings, obvious modifications and variations are possible in the light of the above teachings. It is therefore to be understood that within the scope of the appended claims, the invention may be practiced otherwise than as specifically described.

What is claimed as new and desired to be secured by Letters Patent of the United States is:

1. Digging apparatus comprising:

(a) an arm;

(b) a first bracket mounted on said arm for pivotal movement relative thereto about a first pivot shaft;

(c) a bucket mounted on said first bracket for pivotal movement relative thereto about a second pivot shaft;

(d) a first hydraulic cylinder having a first piston rod;

(e) a first link having a first end and a second end, the first end of said first link being pivotally mounted on said arm and said first bracket for pivotal movement relative thereto about a third pivot shaft and the second end of said first link being pivotally mounted on said first piston rod for pivotal movement relative thereto about a fourth pivot shaft;

(f) a second link having a first end and a second end, the first end of said second link being pivotally mounted on said first piston rod for pivotal movement relative thereto about said fourth pivot shaft and the second end of said second link being pivotally mounted on said bucket for pivotal movement relative thereto about a fifth pivot shaft;

(g) a holding arm mounted on said first bracket for pivotal movement relative thereto about a sixth pivot shaft; and (h) a third link having a first end and a second end, the first end of said third link being pivotally mounted on said holding arm for pivotal movement relative thereto about a seventh pivot shaft and the second end of said third link being pivotally mounted on said bucket for pivotal movement relative thereto about a seventh pivot shaft, whereby extension of said first piston rod relative to said first hydraulic cylinder causes said bucket to pivot relative to said arm from a first position to a second position and said holding arm to pivot relative to said first bracket from a first position in which said holding arm extends away from said bucket to a second position in which said holding arm extends into close proximity of said bucket.

2. Digging apparatus as recited in claim 1 wherein:

(a) said bucket comprises a bucket section and a second bracket and (b) said second pivot shaft, said fifth pivot shaft, and said seventh pivot shaft are all journaled in said second bracket.

3. Digging apparatus comprising:

(a) an arm;

(b) a first bracket mounted on said arm for pivotal movement relative thereto about a first shaft;

(c) a bucket mounted on said first bracket for pivotal movement relative thereto about a second pivot shaft;

(d) a first hydraulic cylinder having a first piston rod;

(e) a first link having a first end and a second end, the first end of said first link being pivotally mounted on said arm and said first bracket for pivotal movement relative thereto about a third pivot shaft and the second end of said first link being pivotally mounted on said first piston rod for pivotal movement relative thereto about a fourth pivot shaft;

(f) a second link having a first end and a second end, the first end of said second link being pivotally mounted on said first piston rod for pivotal movement relative thereto about said fourth pivot shaft and the second end of said second link being pivotally mounted on said bucket for pivotal movement relative thereto about a fifth pivot shaft;

(g) a holding arm mounted on said first bracket for pivotal movement relative thereto about a sixth pivot shaft; and (h) a second hydraulic cylinder having a second piston rod, said second hydraulic cylinder being mounted on said first bracket, said holding arm being pivotally mounted on said second piston rod for pivotal movement relative thereto about an eighth pivot shaft, whereby extension of said first piston rod relative to said first hydraulic cylinder causes said bucket to pivot relative to said arm from a first position to a second position and simultaneous extension of said second piston rod relative to said second hydraulic cylinder causes said holding arm to pivot relative to said first bracket from a first position in which it extends away from said bucket to a second position in which it extends into close proximity of said bucket.

4. Digging apparatus as recited in claim 3 wherein:

(a) said bucket comprises a bucket section and a second bracket and (b) said second pivot shaft and said fifth pivot shaft are both journaled in said second bracket.

* * * * *